US005142481A

United States Patent [19]

Cox

[11] Patent Number: 5,142,481

[45] Date of Patent: Aug. 25, 1992

[54] PROCESS AND APPARATUS ALLOWING THE REAL-TIME DISTRIBUTION OF DATA FOR CONTROL OF A PATTERNING PROCESS

[75] Inventor: Steven W. Cox, Chesnee, S.C.

[73] Assignee: Milliken Research Corporation, Spartanburg, S.C.

[21] Appl. No.: 487,552

[22] Filed: Mar. 2, 1990

[51] Int. Cl.[5] ..... G06F 15/46; D06B 1/02

[52] U.S. Cl. ..... 364/470; 8/149; 68/205 R; 427/288

[58] Field of Search ..... 364/469, 470, 200 MS File, 364/900 MS File; 68/205 R; 239/426; 8/149, 151, 158; 118/697, 699; 427/288; 112/80.23, 80.3

[56] References Cited

U.S. PATENT DOCUMENTS

| | | | |
|---|---|---|---|
| 3,894,413 | 7/1975 | Johnson | 68/205 R |
| 4,019,036 | 4/1977 | Hiramatsu et al. | 364/470 |
| 4,033,154 | 7/1977 | Johnson | 68/205 R |
| 4,116,626 | 9/1978 | Varner | 8/149 |
| 4,170,883 | 10/1979 | Varner | 68/205 R |
| 4,545,086 | 10/1985 | Varner | 8/151 |

*Primary Examiner*—Joseph Ruggiero
*Attorney, Agent, or Firm*—Kevin M. Kercher; H. William Petry

[57] ABSTRACT

A textile dyeing apparatus enables the real-time selection of destinations for pattern information. A pattern control system has a plurality of destinations for receiving pattern information. The pattern control system includes means for selecting one of the destinations in response to a selectional signal. A processor coupled to the pattern control system transfers the pattern information. The processor includes a first memory for locally storing the pattern information and a programmable direct memory access controller board, coupled to said first memory. The board initiates the transfer of the pattern information from the first memory in response to a transfer signal from the processor. The processor also includes an output data bus, receiving the transferred pattern information, coupled in parallel with the inputs of the plurality of destinations in the pattern control system, and a selection circuit providing the selection signal in real-time to the means for selecting in response to selection information stored in the first memory.

26 Claims, 5 Drawing Sheets

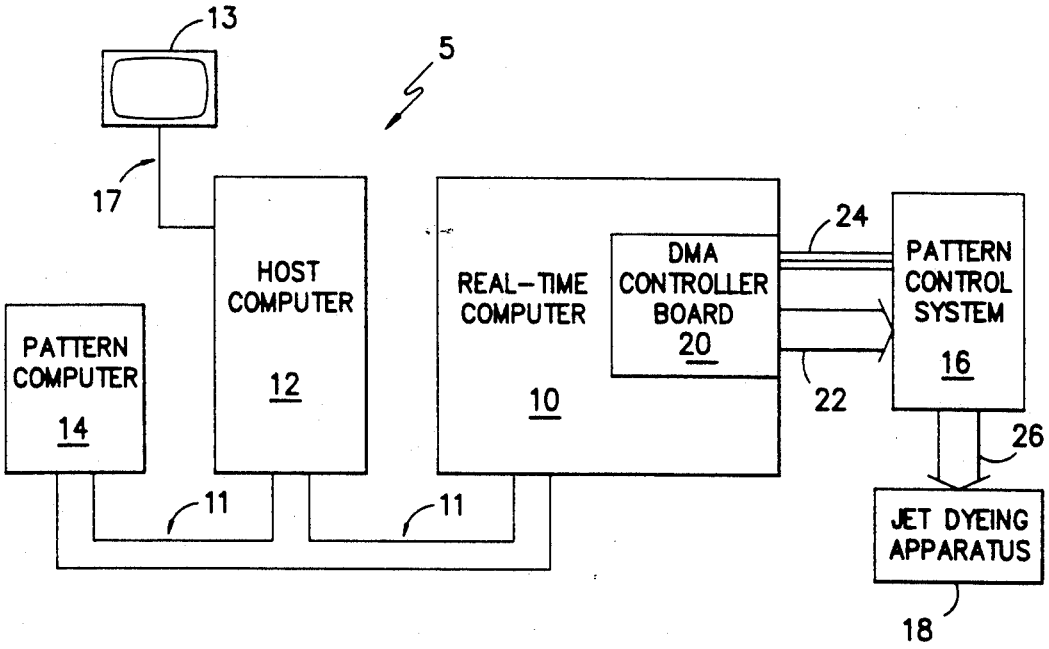
*FIG. —1—*

PROCESS AND APPARATUS ALLOWING THE REAL-TIME DISTRIBUTION OF DATA FOR CONTROL OF A PATTERNING PROCESS

FIELD OF THE INVENTION

This invention relates to an electronic data loading and distribution system and, more particularly, to a system using a programmable direct memory access controller for the real-time selection of destinations for digitally encoded data.

The system may be used to control the selective application of dyes or other marking materials to a moving substrate in accordance with digitally encoded pattern data. The programmable direct memory access controller allows multiple patterns or repetitions of the same pattern to be generated by a pattern control system across the width of the substrate in real-time as opposed to being generated off-line and ahead of time.

BACKGROUND OF THE INVENTION

This invention, in particular, finds application in the field of textile dyeing. A known modern textile dyeing apparatus includes multiple arrays, each comprising a plurality of individual, electronically addressable dye jets. Each of the dye jets in a single array outputs the same color of dye. The arrays are positioned in spaced relation across the path of a moving substrate.

Using such apparatus, the pattern-wise application of dye to the textile materials or substrates requires a large quantity of digitally encoded pattern data which must be sorted and routed to each of the individual dye jets comprising each of the arrays. Each of the arrays of dye jets extends across the width of the substrate path as the substrate moves under the arrays. It has been found advantageous to control individually the time period during which the dye streams produced by the individual dye jets in a given array are allowed to strike the substrate. This allows for shade variations to be produced from side-to-side (and end-to-end) on the substrate by varying the quantity of dye applied to the substrate along the length of a given array.

One such control system capable of providing this capability is described in co-pending U.S. Ser. No. 327,843, entitled "DATA LOADING AND DISTRIBUTING PROCESS AND APPARATUS FOR CONTROL OF A PATTERNING PROCESS", filed on Mar. 23, 1989, now U.S. Pat. No. 4,984,169, the specification of which is hereby incorporated by reference. This system, which is applicable to a variety of marking or patterning systems wherein large quantities of pattern data must be allocated and delivered to a large number of individually controllable imaging locations, processes pattern data received from a real-time processor through the use of specific electronic circuitry which accepts the pattern data in the form of a series of 8-bit units. Each of the 8-bit units uniquely identifies, for each pattern element or pixel, a pattern design element to be associated with that pattern element or pixel.

The term "pattern element" as used herein is intended to be analogous to the term "pixel" as that term is used in the field of electronic imaging. The number of different pattern design elements is equal to the number of district areas of the pattern which may be assigned a separate color.

The term "pattern line" as used herein is intended to describe a continuous line of single pattern elements extending across the substrate, parallel to the patterning arrays. Such pattern lines have a thickness, measured in the direction of substrate travel, equal to the maximum permitted amount of substrate travel under the patterning arrays between array pattern data updates.

In this system, the pattern element data must first be converted to "on/off" firing instructions, (referring to the actuation or deactuation, respectively, of the individual dye streams produced by the dye jets). This is performed by electronically associating the "raw" pattern data with pre-generated firing instruction data from a computer generated look-up table. The raw patterning data is in the form of a sequence of pixel codes. The pixel codes merely define those distinct areas of the pattern which may be assigned a distinguishing color. Each code specifies, for each pattern line, the dye jet response for a given dye jet position on each and every array. In this system the number of arrays equals eight; therefore, each pixel code controls the response of eight separate dye jets (one per array) with respect to a single pattern line.

The raw pattern data for a given array is preferably arranged in sequence, with data for dye jets 1-N for the first pattern line being first in the series, followed by data for dye jets 1-N for the second pattern line, etc. The complete serial stream of such pixel codes is sent to a firing time converter and memory associated with each respective array for conversion of the pixel codes into the respective firing times.

Each firing time converter includes a look-up table having a sufficient number of addresses so that each possible address code forming the serial stream of pattern data may be assigned a unique address in the look-up table. At each address within the look-up table is a byte representing a relative firing time or dye contact time, which, assuming an 8-bit value at the address code of interest, can be zero or one of 255 different discreet time values corresponding to the relative amount of time the dye jet in question is to remain "on". Therefore, each specific dye jet location on each and every array can be assigned one of 256 different firing times.

The firing time data from the look-up table for each array is then further processed to account for the "stagger", e.g., the physical spacing between arrays, and the allocation of the individual firing instructions for each jet in the array. Finally, the individual firing instructions for each jet in the array are sent in parallel to the jet dyeing apparatus for actuation of the individual jets in each array.

These systems require a full line of pattern data to be stored in the real-time processor memory for output to the pattern control system. When it is desired to generate different patterns or repetitions of the same patterns across the width of the substrate, each pattern to be generated must first be converted into a "full machine width" pattern line. For example, the individual corresponding pattern lines of each of three separate patterns must be combined into a single set of composite pattern lines which individually extend across the entire substrate. Because this combining of pattern data into full width pattern lines is a computationally intensive process, it must be done "off-line" from the operation of the dyeing apparatus. Further, the entire pattern must then be written into memory which requires an extremely large memory.

One alternative to formatting the patterns off-line and producing the patterns in an "across the width" format would be to eliminate the "full machine width" conversion process and simply produce each individual pattern, in real-time, down the substrate rather than across. However, it is readily apparent that a tremendous amount of the substrate would then be wasted. For example, a twelve foot wide substrate used to produce a pattern only three feet wide, such as would be suitable for a hall or "runner" carpet, for instance, would waste the remaining nine feet across the substrate width.

There is therefore a need for a process and apparatus which produces multiple patterns or repetitions of the same pattern across the substrate in real-time. Further, the process and apparatus should be capable of producing the pattern beginning at any point along the width of the substrate or be capable of starting the given pattern at any point in the pattern for proper centering of the pattern across the substrate and thus not delivering dye to the edges of the substrate.

SUMMARY OF THE INVENTION

The present invention overcomes these problems with the use of a programmable direct memory access ("DMA") controller to assist in the real-time selection and production of multiple patterns or repetitions of the same pattern to be generated across the substrate. The individual pattern data may be stored in separate memory locations which are then accessed in any desired sequence upon demand by the DMA controller. As discussed above, the control system is believed to be applicable to a variety of marking or patterning systems wherein large quantities of different pattern data must be allocated and delivered to a large number of individually controllable imaging locations, and is not limited to use in connection with the patterning devices disclosed herein.

In a preferred embodiment using the present invention, the programmable DMA controller, without intervention by the real-time processor, retrieves the same pattern data from memory a desired number of times to repeat the pattern across the width of the substrate. The DMA controller operates in real-time to combine the patterns into a full machine width pattern line for output to the pattern control system. Thus, unlike systems of the prior art, only a single copy of the pattern data need be stored in the memory to produce a repetitive number of the patterns. This results in a dramatic reduction in the size of the memory associated with the real-time processor used to store the pattern data.

The control system of the instant invention uses the channel select lines provided by the DMA controller to selectively enable in real-time one of a number of different destinations for the data output from the real-time processor. Because of this capability, an alternate embodiment of the present invention provides for the DMA channel select lines to select one of a plurality of look-up tables associated with each array in conjunction with the retrieval of different patterns from the real-time processor memory. Thus, each pattern that is combined into the full machine width pattern lines will have its respective correct look-up table of firing times available when the pattern data is processed by the pattern control system. This allows multiple different patterns, or portions of a large, overall pattern (which, by dividing the pattern into areas which individually require no more than 256 pattern elements, will allow use of more than 256 pattern elements in the overall pattern) to be produced across the width of the substrate in real-time.

These and other advantages are provided by proper programming of the direct memory access controller. It is thus possible to change the pattern sequences "on-line" which results in a savings in time, substrate material, and memory.

Details of the present invention herein, as well as additional advantages and distinguishing features, will be better understood with reference to the following figures.

BRIEF DESCRIPTION OF THE DRAWINGS

FIG. 1 is a block diagram illustrating one pattern control system environment in which the present invention may operate.

DETAILED DESCRIPTION

Figure 2A:
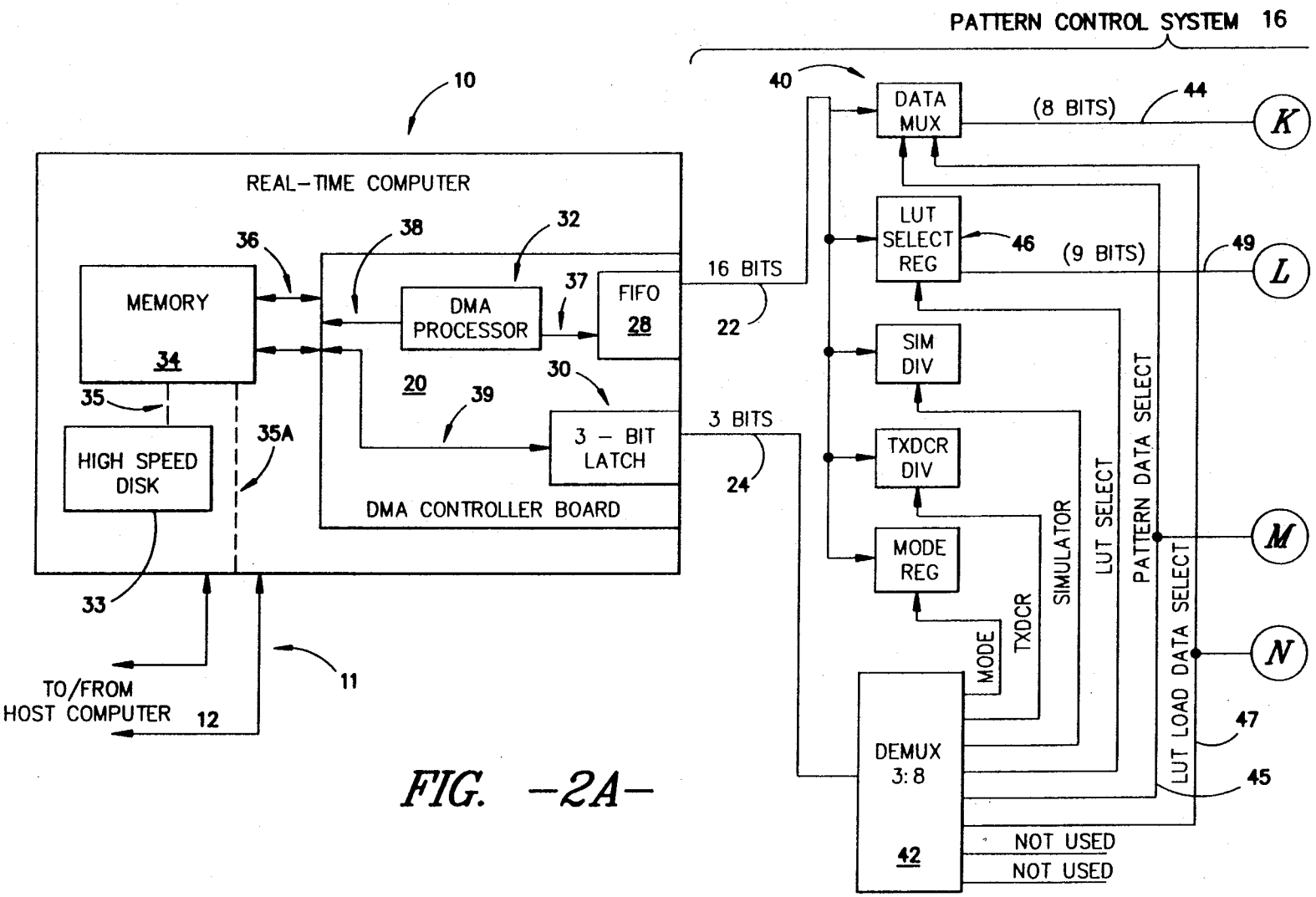
FIGS. 2A and 2B constitute a schematic block diagram illustrating in greater detail the real-time computer and pattern control system of FIG. 1 and, more specifically, illustrating the programmable DMA controller's interface with the pattern control system of FIG. 1.

For purposes of this discussion, the programmable DMA controller and control system of the present invention will be described in conjunction with the jet patterning apparatus discussed above and to which this invention is particularly well suited. It should be understood, however, that the operation of the programmable DMA controller and control system of the instant invention may be used, perhaps with obvious modifications, in other devices where similar quantities of digitized pattern data must be distributed in real-time to different destinations.

Referring to FIG. 1, a multiprocessor patterning system 5 is shown having a host computer 12 coupled via a bus 11 to a real-time computer 10. Optional pattern computer 14 is further coupled to the host computer 12 and real-time computer 10 by the bus 11. It is readily apparent that the coupling of the pattern computer 14, host computer 12 and real-time computer 10 may be by any means for coupling a local area network (LAN) such as an Ethernet bus.

A pattern control system 16 is coupled via bus 26 to a jet dyeing apparatus 18. The jet dyeing apparatus 18 may be of the type generally described in greater detail in, for example, commonly assigned U.S. Pat. Nos. 3,894,412, 3,942,343, 3,969,779, 4,033,154, 4,034,584, 4,116,626, 4,309,881, 4,434,632 and 4,584,854.

The pattern control system 16 receives inputs from bus 22 and channel select lines 24 of the programmable DMA controller board 20. The programmable DMA controller board 20 is part of the real-time computer 10 and is described in greater detail in FIG. 2.

Optional pattern computer 14 may be provided to allow a user of the system to quickly create their own pattern design. Alternatively, pattern designs may be pre-loaded onto magnetic or optical media for reading into the system. A computer terminal 13 may be coupled via a suitable connection 17, e.g., a standard RS232 cable, to the host computer 12. The terminal 13 then serves as the operator's interface for providing the input parameters to the host computer for each "job" of patterns to be generated on the substrate by jet dyeing apparatus 18. The host computer 12 also fetches the pattern data from the pattern computer or other source and sets it up for processing by the real-time computer 10. The real-time computer 10 functions to insure that the pattern data is properly output to the pattern control system 16 by programming appropriately the DMA controller board 20.

Figure 2B:
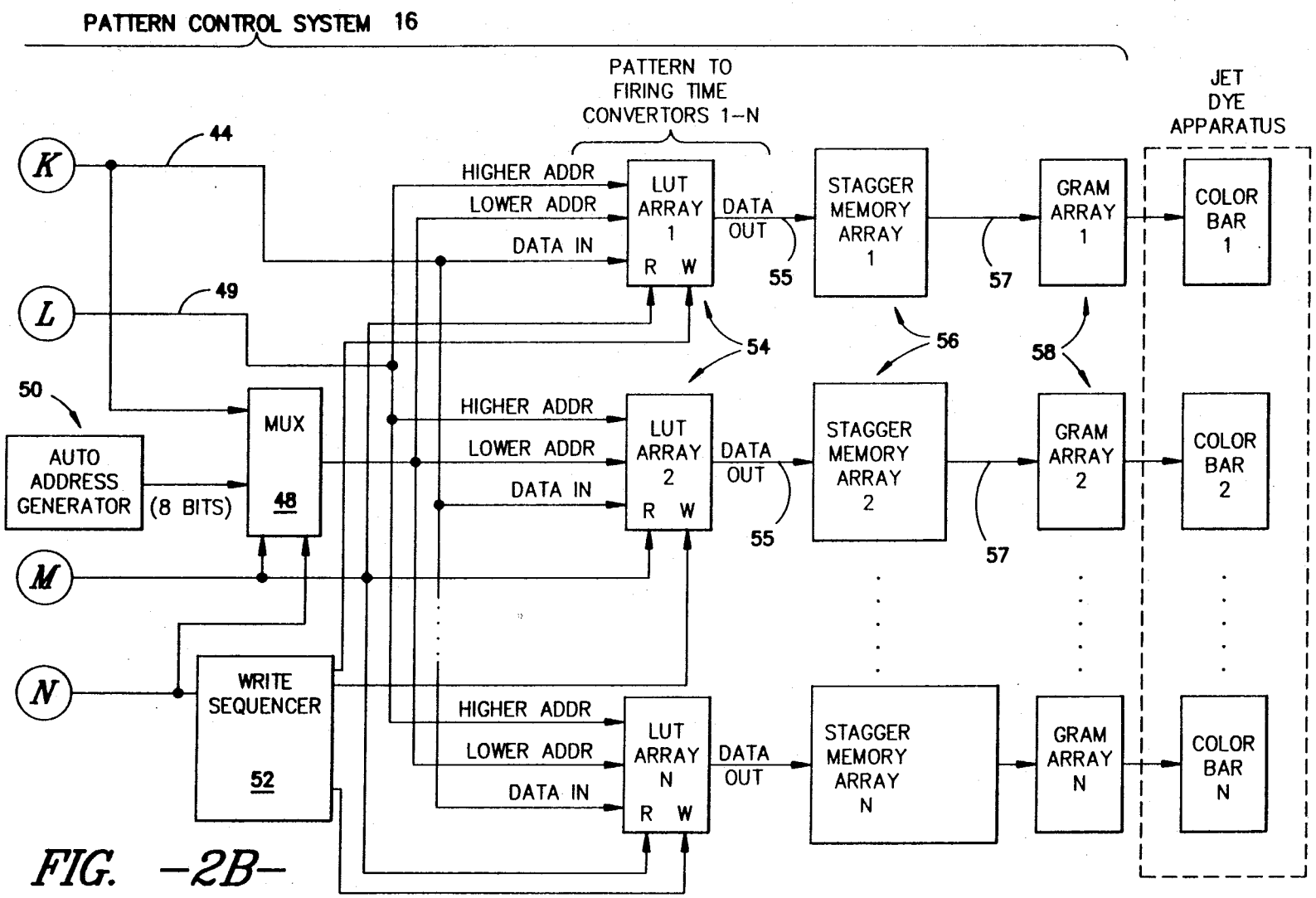

Referring to FIG. 2, the real-time computer 10 is shown having memory 34 and programmable DMA controller board 20. Pattern data is received from the host computer 12 via the bus 11 and stored on high speed disk 33 by way of diagrammatically depicted links 35 and 35A, which typically may be comprised of an I/O bus, associated bus interface units, and an appropriate network interface unit, not shown. As appropriate, data is moved from high speed disk 33 into memory 34, via link 35, for access by DMA controller 20 via bus 36.

The programmable DMA controller board 20 is shown comprising a programmable DMA processor 32, FIFO buffer 28 and 3-bit latch 30. The programmable DMA processor 32 couples with bus 36 via line 38 and with FIFO buffer 28 via line 37. Further, the 3-bit latch 30 is coupled to the bus 36 via line 39. It should be understood that FIG. 2 shows only a simplified diagrammatically depicted version of the programmable DMA controller board 20. A more complete and accurate description of the controller board 20 can be found by consulting the specifications thereof; for example, the controller board 20 may be of the type produced by Digital Equipment Corporation as Model DRQ3B or may be the Intel 82258 DMA chip used in conjunction with a host computer card such as the Intel 286/12 Board.

Pattern numbers chosen by the operator using terminal 13 are entered via line 17, into host computer 12 (FIG. 1). Computer 12 loads pattern data from, e.g., pattern computer 14, onto high speed disk 33, and then sends data messages to real-time computer 10. Computer 10, on receipt of such messages, loads the requested pattern data from high speed disk 33 into memory 34. When requested by means of an interrupt, as by the occurrence of a transducer pulse indicating a predetermined length of substrate has passed under the patterning jets, the real-time computer 10 commands the DMA controller 20 to initiate the transfer of the appropriate pattern data stored in memory 34 to the pattern control system 16, via FIFO buffer 28.

In one embodiment, a first-in-first-out (FIFO) buffer 28 stores words (16-bits) of pattern data in each buffer location. The pattern data stored in FIFO buffer 28 is then output to the pattern control system 16 along the high-speed (e.g., 2.6 megabytes/second) data bus 22. The FIFO buffer 28 serves as an interface between the rate at which data is placed into the FIFO buffer 28 by DMA processor 32 and the rate at which data is output to the pattern control system 16. If the pattern control system 16 operates at a rate equal to or greater than that of the real-time processor 10, FIFO buffer 28 would not be needed to perform the interface function.

In accordance with commands from the real-time computer 10, the DMA processor 32 also functions to request memory 34 to provide inputs via line 39 to the 3-bit latch 30. The latch 30 provides a parallel output on the three channel select lines 24 to the pattern control system 16.

The demultiplexer 42 receives the channel select lines 24 and provides one of eight outputs depending upon the state of the channel select lines 24. The demultiplexer 42 may be any suitable conventional 3-to-8 type demultiplexer.

A portion of the pattern control system 16 is shown in FIG. 2 having a 3:8 demultiplexer 42, a series of 16-bit registers, and a 16-to-8 bit data multiplexer 40.

Multiplexer 40 receives the 16-bit words (when either the pattern data select line 45 or the LUT load data select line 47 is selected by the channel select lines 24, through demultiplexer 42) over data bus 22 from the FIFO buffer 28 in the programmable DMA controller board 20. The 16-bit multiplexer 40 then provides single byte (8 bit) write outputs over 8-bit bus 44. Therefore, the data multiplexer 40 serves to convert each 16-bit parallel word into a sequence of two bytes over 8-bit parallel bus 44 for pattern data or LUT load data. The bus 44 is further coupled in parallel with an array of N firing time converters (numbers 1 through N), each firing time converter corresponding to one of N arrays of individual dye jets. Each firing time converter 1 though N includes a plurality of look-up tables (LUT arrays 1 through N) addressed by the contents of the LUT select register 46 which provides the upper address lines to each firing time converter array. Each firing time converter array may be thought of as a simple high speed static memory having address lines, data-in lines, data-out lines, and read and write control lines.

The other four 16-bit registers can be loaded by selecting the appropriate register with the channel select lines and providing the desired value on 16-bit bus 22.

One of the four 16-bit registers loaded by bus 22 is the look-up table (LUT) select register 46. In the embodiment shown in FIG. 2, 9 bits from the LUT select register provide the upper nine address lines to each LUT array (1 through N), thus providing 512 LUTs for each respective array. For purposes of discussion, this embodiment is assumed to include 8 arrays (N=8) and, as mentioned above, 512 LUTs per array. Each look-up table has a sufficient number of addresses so that each possible address code forming the serial stream of pattern data may be assigned a unique address in each of the look-up tables. At each address within the look-up table is a byte representing a relative firing time or dye contact time. Assuming an 8 bit address code used to form the raw pattern data, the firing time can be zero or one of 255 different discrete time values corresponding to the relative amount of time the dye jet in question is to remain "on". Accordingly, for each 8 bit byte of pixel data, one of 256 different firing times (including a firing time of zero) is defined for each specific jet location on each and every array 1–N. Jet identity within a given array is determined by the relative position of the address code within the serial stream of pattern data and by the information pre-loaded into the look-up tables, which information specifies in which arrays a given jet position fires, and for what length of time.

The 8-bit bus 44 from DATA MUX 40 is connected in parallel to the data inputs of the firing time converters. It is also connected to the input of MUX 48. Connected to the other input of MUX 48 is AUTO address generator 50. Depending on the state of channel select lines 24, one or the other of these inputs can be connected to the lower address lines of each LUT array. To load an array with conversion data, select lines 24 activate the LUT load data select line 47. This "enables" DATA MUX 40, as well as connects AUTO address generator 50 through MUX 48 to the lower address lines of each LUT array in sequence, and provides a sequential "write enable" through sequencer 52 to each LUT within each LUT array selected by LUT select register 46 for each LUT array. (The first 256 bytes on bus 44 are loaded into LUT array 1; the second 256 bytes are loaded into LUT array 2, etc.)

To output pattern data through the LUT's, select lines 24 activate the pattern data select line 45, which "enables" DATA MUX 40, routes data on bus 44 through MUX 48 to the lower address lines of each LUT array, and provides a "read enable" signal to each LUT array such that data from bus 44 selects the appropriate contents (i.e., firing time) of each LUT selected by the LUT select register 46. This firing time is output on its respective data out bus 55 to each stagger memory array 56. Thus, depending upon the output from channel select lines 24 of the programmable DMA controller 20, the enabling of one of the eight possible output lines from demultiplexer 42 directs where data from bus 22 will go (i.e., to one of the 16 bit registers, or through DATA MUX 40 to the data inputs of the LUT arrays, or channeled through MUX 48 to the lower address lines of each LUT array).

The firing time information from the LUT arrays comprising firing time converters 1-N is supplied to a respective stagger memory 56 for each of the LUT arrays 1-N. The stagger memories 56 1-N function to compensate for the time necessary for the substrate to be patterned to travel from array to array due to the physical spacing between the arrays in the jet dyeing apparatus. The stagger memory 56 operates on the firing time data produced by LUT arrays 54 and performs two principal functions: (1) the serial data stream from the LUT array, representing firing times, is grouped and allocated to the appropriate arrays on the patterning machine and (2) "non-operative" data is added to the respective pattern data for each array to inhibit, at start up and for a predetermined interval which is specific to that particular array, the reading of the pattern data in order to compensate for the elapsed time during which the specific portion of the substrate to be patterned with that pattern data is moving from array to array. The precise operation of the staggered memories is described fully in co-pending Ser. No. 327,843 referenced above.

The stagger memories 56 provide their output to a "Gatling" memory module 58 for each array. The Gatling memory 58 performs two principal functions: (1) the serial stream of encoded firing times is converted to individual strings of logical (i.e., "on" or "off") firing commands, the length of each respective "on" string reflecting the value of the corresponding encoded firing time, and (2) these commands are quickly and efficiently allocated to the appropriate dye jets. Thus, the Gatling memory arrays serve to distribute the encoded firing times to the appropriate jets for each dye jet array such that the desired pattern is produced on the substrate moving under the dye jet arrays. Again, as noted above, a complete description of the Gatling memory modules is provided in co-pending Ser. No. 327,843.

It is readily apparent that because the DMA controller can be programmed to change the channel select lines 24 in real-time, it is possible to enable different look-up tables in each of the arrays by reloading LUT select register 46 in real-time between pattern data outputs, for the processing of different pattern data across the width of the substrate. This allows multiple (different or identical) patterns to be printed side-by-side in real-time, each with its own look-up table of firing times.

An example showing a typical use of this system is now described below, in which two different patterns are produced across the substrate using the programmable DMA controller 20.

Figure 3:
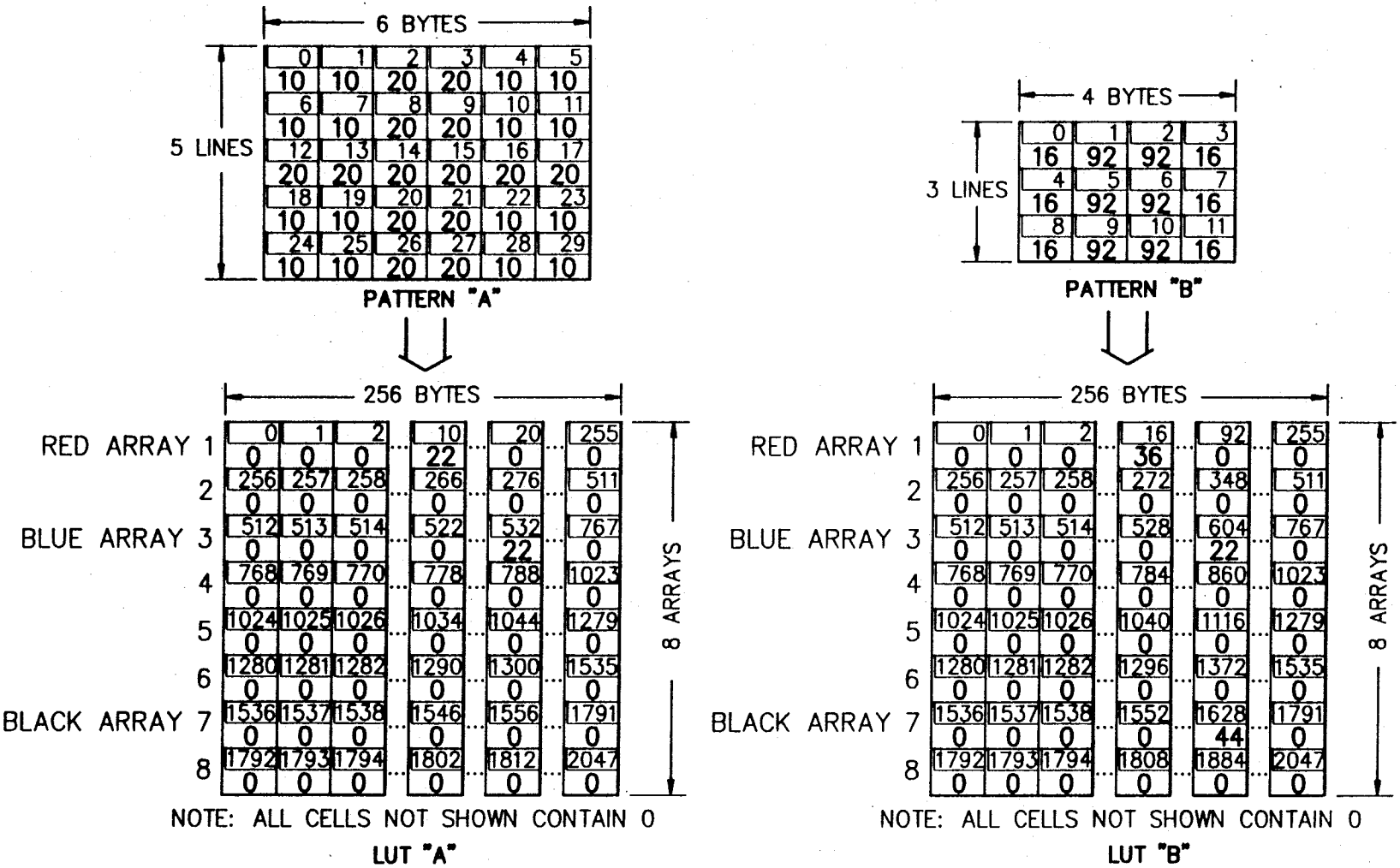
FIG. 3 illustrates an example of two patterns and their associated look-up tables stored in the real-time computer memory.
Figure 4:
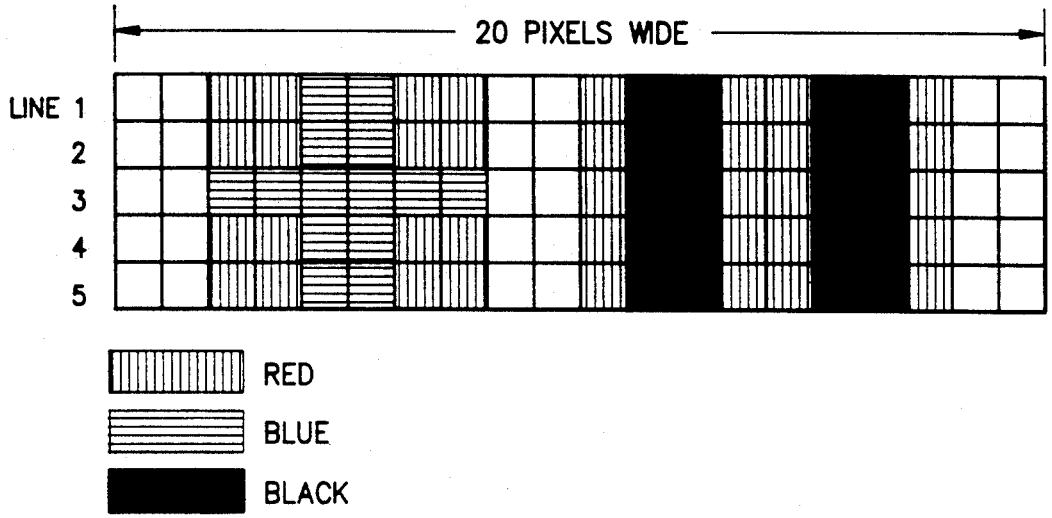
FIGS. 4 and 4A illustrate portions of a substrate patterned in accordance with the examples of FIG. 3.

FIG. 3 is an example showing PATTERN A and PATTERN B as they exist in memory 34 (FIG. 2). Also shown are look-up tables A and B as they exist in memory 34. Real-time computer 10 loads these items in memory 34 prior to the time that they are actually needed. FIG.4 illustrates the finished product or pattern of producing one repeat of PATTERN A and two repeats of PATTERN B on the substrate.

Referring again to the example of FIG. 3, PATTERN A is shown being six pixels wide by five pattern lines long. It is arranged in memory 34 as a sequence of 30 contiguous bytes as indicated by the relative address (in memory numbers) in the upper right portion of the cells. This pattern contains two different pattern elements numbered "10" and "20". These are two independent areas of the pattern which will generate two different colors on the final product. The look-up table for PATTERN A (LUT A) serves to translate the PATTERN A elements into firing time information for each dye jet array.

Note that element 10 translates to firing time 22 (typically in milliseconds) for the RED ARRAY and element 20 translates to firing time 22 for the BLUE ARRAY. This means that area 10 will be RED on the final substrate and area 20 will be BLUE. Firing time 22 is a relative amount of time to deliver dye from the dye jets which is directly proportional to the amount of dye delivered. PATTERN B and its associated look-up table LUT B will be translated in a similar manner to PATTERN A. The finished product will be as shown in FIG. 4.

A sequence of DMA commands for producing the product of FIG. 4 is given in Table 1 below. Real-time computer 10 sets up these commands in memory and instructs DMA controller 20 to execute them at the appropriate time. The appropriate time is determined by means of an interrupt such as a transducer pulse occurring after a predetermined length of substrate has travelled under the jet dyeing apparatus for each pattern line.

TABLE 1

| | |
|---|---|
| Line 0 Group 1 | SET CHANNEL SELECT LINES = LUT SELECT<br>OUTPUT LUT NUMBER = 1<br>WAIT ON FIFO EMPTY |
| Line 0 Group 2 | SET CHANNEL SELECT LINES = LUT LOAD<br>OUTPUT LUT A<br>WAIT ON FIFO EMPTY |
| Line 0 Group 3 | SET CHANNEL SELECT LINES = LUT SELECT<br>OUTPUT LUT NUMBER = 0<br>WAIT ON FIFO EMPTY |
| Line 0 Group 4 | SET CHANNEL SELECT LINES = PATTERN DATA<br>OUTPUT LAST LINE OF PREVIOUS PATTERN |
| Line 1 Group 1 | SET CHANNEL SELECT LINES = LUT SELECT<br>OUTPUT LUT NUMBER = 2<br>WAIT ON FIFO EMPTY |
| Line 1 Group 2 | SET CHANNEL SELECT LINES = LUT LOAD<br>OUTPUT LUT B<br>WAIT ON FIFO EMPTY |
| Line 1 Group 3 | SET CHANNEL SELECT LINES = LUT SELECT<br>OUTPUT LUT NUMBER = 1 |

TABLE 1-continued

| | |
|---|---|
| | WAIT ON FIFO EMPTY |
| Line 1 Group 4 | SET CHANNEL SELECT LINES = PATTERN DATA<br>OUTPUT 2 BYTES = 255<br>OUTPUT FIRST LINE OF PATTERN A (6 BYTES)<br>OUTPUT 2 BYTES = 255<br>WAIT ON FIFO EMPTY |
| Line 1 Group 5 | SET CHANNEL SELECT LINES = LUT SELECT<br>OUTPUT LUT NUMBER = 2<br>WAIT ON FIFO EMPTY |
| Line 1 Group 6 | SET CHANNEL SELECT LINES = PATTERN DATA<br>OUTPUT FIRST LINE OF PATTERN B (4 BYTES)<br>OUTPUT FIRST LINE OF PATTERN B (4 BYTES)<br>OUTPUT 2 BYTES = 255 |
| Line 2 Group 1 | SET CHANNEL SELECT LINES = LUT SELECT<br>OUTPUT LUT NUMBER = 1<br>WAIT ON FIFO EMPTY |
| Line 2 Group 2 | SET CHANNEL SELECT LINES = PATTERN DATA<br>OUTPUT 2 BYTES = 255<br>OUTPUT SECOND LINE OF PATTERN A (6 BYTES)<br>OUTPUT 2 BYTES = 255 |
| Line 2 Group 3 | SET CHANNEL SELECT LINES = LUT SELECT<br>OUTPUT LUT NUMBER = 2<br>WAIT ON FIFO EMPTY |
| Line 2 Group 4 | SET CHANNEL SELECT LINES = PATTERN DATE<br>OUTPUT SECOND LINE OF PATTERN B (4 BYTES)<br>OUTPUT SECOND LINE OF PATTERN B (4 BYTES)<br>OUTPUT 2 BYTES = 255 |
| Line 3 | SAME AS LINE 2 EXCEPT THIRD LINE OF PATTERNS A & B OUTPUT |
| Line 4 | SAME AS LINE 2 EXCEPT FOURTH LINE OF PATTERN A OUTPUT AND FIRST LINE OF PATTERN B OUTPUT |
| Line 5 | SAME AS LINE 2 EXCEPT FIFTH LINE OF PATTERN A OUTPUT AND SECOND LINE OF PATTERN B OUTPUT |

Line 0 must occur sometime prior to line 1. In this example, it will be the last pattern line of the previous pattern. The first command in Group 1 for line 0, SET CHANNEL SELECT LINES=LUT SELECT, provides an output on channel select lines 24 to the demultiplexer 42 which signals the write enable line "LUT SELECT" coupled to LUT select register 46. The next command, OUTPUT LUT NUMBER=1, instructs the DMA controller board 20 to provide as an output on bus 22 a word of data (16 bits with only 9 bits used in this embodiment) equal to 1, which identifies the look-up table number to the LUT select register 46. The look-up table select register 46 selects, via bus 49, the correct look-up table in the respective firing time converters 1-N 54, in accordance with the look-up table number, that will be used in succeeding operations.

The third command, WAIT ON FIFO EMPTY, is provided to allow the FIFO BUFFER 28 to be emptied prior to changing the channel select lines 24. This insures that all data meant to go to the LUT select register 46 has been distributed. It is readily apparent that this command would not be necessary if the FIFO 28 were not in the system. For the present embodiment, this command instructs the DMA controller 20 to read its own status register and mask (not shown), and compare it to determine when a FIFO empty bit becomes set, and then proceed to the next command when a match is detected.

The first command in Group 2, SET CHANNEL SELECT LINES =LUT LOAD, enables the LUT LOAD DATA SELECT line 47 from demultiplexer 42 which is coupled to DATA MUX 40, WRITE SEQUENCER 52 and MUX 48. This enables the next command, OUTPUT LUT A, to provide the firing time data contained in LUT A as shown in FIG. 3 on bus 44 to load the selected look-up table (in this case LUT 1) in each array sequentially as controlled by AUTO ADDRESS generator 50 and WRITE SEQUENCER 52. Again, a WAIT ON FIFO EMPTY command is included to allow the FIFO buffer 28 to empty before changing the channel select lines 24. These commands essentially load LUT A into LUT 1 in firing time convertors 1-N 54.

The first command in Group 3, SET CHANNEL SELECT LINES=LUT SELECT, provides an output on channel select lines 24 to the demultiplexer 42 which signals the write enable line, LUT SELECT, coupled to LUT select register 46. The next command, OUTPUT LUT NUMBER=0, instructs the DMA controller board 20 to provide as an output 0 on bus 22. This number is written into LUT select register 46. Again, a WAIT ON FIFO EMPTY command is included to allow the FIFO buffer 28 to empty before changing the channel select lines 24. These commands essentially connect LUT 0 for subsequent operations.

The first command in Group 4, SET CHANNEL SELECT LINES=PATTERN DATA, changes the channel select lines 24 such that demultiplexer 42 asserts the PATTERN DATA select line 45. This enables data from bus 44 to be input on the lower address lines for the firing time converters such that each pattern element translates in parallel to the appropriate firing time for each array through firing time convertors 1-N 54 for LUT 0 as selected above. Finally, the command, OUTPUT LAST LINE OF PREVIOUS PATTERN, sends the pattern data fetched from real-time computer memory 34 through the enabled DATA MUX 40 to be output on bus 44 through MUX 48, to the lower address lines of the firing time converters 1-N. The pattern data output on bus 44 is a serial stream of 8-bit pattern elements which act as addresses for the selected LUT (0) in each array 1-N. The parallel output from firing time converters 1-N 55 drives stagger memories 56 which output data on bus 57 which drives Gatling memories 58 which finally activates the appropriate dye jets in each dye jet array for the specified times for the appropriate line of data.

Once the LUT A is loaded into LUT 1 in the firing time convertors 1-N 54, the system is ready to output LINE 1 of PATTERN's A and B (FIG. 3). The first command of Group 1 for line 1, SET CHANNEL SELECT LINES=LUT SELECT, provides an output on channel select lines 24 to the demultiplexer 42 which signals the write enable line LUT SELECT coupled to LUT select register 46. The next command, OUTPUT LUT NUMBER=2, identifies the look-up table number to the LUT select register 46. The look-up table select register 46 selects, via bus 49, the correct look-up table in the respective firing time convertors 1-N 54, in accordance with the look-up table number, that will be used in succeeding operations. The third command, WAIT ON FIFO EMPTY, is provided to allow the FIFO BUFFER 28 to be emptied prior to changing the channel select lines 24.

The first command in Group 2 for Line 1, SET CHANNEL SELECT LINES=LUT LOAD, enables the LUT LOAD data select line 47 from demultiplexer 42 which is coupled to DATA MUX 40, WRITE SEQUENCER 52 and MUX 48. This enables the next command, OUTPUT LUT B, to provide the firing time data contained in LUT B as shown in FIG. 3 on bus 44 to load the selected look-up table (in this case LUT 2) in each array sequentially as controlled by AUTO ADDRESS generator 50 and WRITE SEQUENCER 52. Again, a WAIT ON FIFO EMPTY command is included to allow the FIFO buffer 28 to empty before changing the channel select lines 24. These commands essentially load LUT B into LUT 2 in firing time converters 1-N 54.

The first command in Group 3 for Line 1, SET CHANNEL SELECT LINES=LUT SELECT, provides an output on channel select lines 24 to the demultiplexer 42 which signals the write enable line LUT SELECT coupled to LUT select register 46. The next command, OUTPUT LUT NUMBER=1, instructs the DMA controller board 20 to provide as an output 1 on bus 22. This number is written into LUT select register 46. Again, a WAIT ON FIFO EMPTY command is included to allow the FIFO buffer 28 to empty before changing the channel select lines 24. These commands essentially connect LUT 1 for subsequent operations.

The first command in Group 4 for Line 1, SET CHANNEL SELECT LINES=PATTERN DATA, changes the channel select lines such that demultiplexer 42 asserts the PATTERN DATA select line 45. This enables data from bus 44 to be input on the lower address lines for the firing time converters such that each pattern element translates in parallel to the appropriate firing time for each array through firing time converters 1-N 54 for LUT 1 loaded with LUT A (FIG. 3) above. The next command, OUTPUT 2 BYTES=255, sends two bytes equal to 255 (an element which translates to zero firing time for all dye jet arrays) from real-time computer memory 34 through the enabled DATA MUX 40 to be output on bus 44 through MUX 48, to the lower address lines of the firing time converters 1-N. These two bytes will essentially assure no dye on the left edge of the final product as shown in FIG. 4. The next command, OUTPUT FIRST LINE OF PATTERN A (6 BYTES), sends the first 6 bytes of PATTERN A (10, 10, 20, 20, 10, 10) from real-time computer memory 34 through the enabled DATA MUX 40 to be output on bus 44 through MUX 48, to the lower address lines of the firing time converters 1-N 54. The resulting looked up firing time information will be 22, 22, 0, 0, 22, 22 for array 1 and 0, 0, 22, 22, 0, 0 for array 3. All remaining arrays include all zeroes. The next command, OUTPUT 2 BYTES=255, sends two bytes equal to 255 (an element which translates to zero firing time for all dye jet arrays) from real-time computer memory 34 through the enabled DATA MUX 40 to be output on bus 44 through MUX 48, to the lower address lines of the firing time converters 1-N. These two bytes will essentially assure no dye between PATTERN A and the two repeats of PATTERN B as shown in FIG. 4. Again, a WAIT ON FIFO EMPTY command is included to allow the FIFO buffer 28 to empty before changing the channel select lines 24.

The first command in Group 5 for Line 1, SET CHANNEL SELECT LINES=LUT SELECT, provides an output on channel select lines 24 to the demultiplexer 42 which signals the write enable line LUT SELECT coupled to LUT select register 46. The next command, OUTPUT LUT NUMBER=2, instructs the DMA controller board 20 to provide as an output 2 on bus 22. This number is written into LUT select register 46. Again, a WAIT ON FIFO EMPTY command is included to allow the FIFO buffer 28 to empty before changing the channel select lines 24. These commands essentially connect LUT 2 for subsequent operations.

The first command in Group 6 for Line 1, SET CHANNEL SELECT LINES=PATTERN DATA, changes the channel select lines such that demultiplexer 42 asserts the PATTERN DATA select line 45. This enables data from bus 44 to be the lower address lines for the firing time converters such that each pattern element translates in parallel to the appropriate firing time for each array through firing time converters 1-N 54 for LUT 2 loaded with LUT B (FIG. 3) above. The next command, OUTPUT FIRST LINE 0F PATTERN B (4 BYTES), sends the first 4 bytes of PATTERN B (16, 92, 92, 16) from real-time computer memory 34 through the enabled DATA MUX 40 to be output on bus 44 through MUX 48, to the lower address lines of the firing time converters 1-N 54. The resulting looked up firing time information will be 36, 0, 0, 36 for array 1 and 0, 44, 44, 0 for array 7 and all zeroes for the remaining arrays. This command essentially produces the first line of the first repeat of PATTERN B. The next command, OUTPUT FIRST LINE OF PATTERN B (4 BYTES), essentially does the same as the last command and produces the second repeat of PATTERN B on the substrate. The next command, OUTPUT 2 BYTES=255, sends two bytes equal to 255 (an element which translates to zero firing time for all dye jet arrays) from real-time computer memory 34 through the enabled DATA MUX 40 to be output on bus 44 through MUX 48, to the lower address lines of the firing time converters 1-N. These two bytes will essentially assure no dye on the right side of the substrate as shown in FIG. 4. This completes all of the commands necessary to produce the first line of the final product.

The series of commands for Line 2 are essentially the same as Groups 3-6 for Line 1 except that the second line for PATTERNs A and B are outputted. The series of commands for Line 3 are essentially the same as for Line 2 except that the third line for PATTERNs A and B are outputted. The series of commands for Line 4 are essentially the same as for Line 2 except that the fourth line of PATTERN A and the first line of PATTERN B is outputted. The series of commands for Line 5 are essentially the same as for Line 2 except that the fifth line of PATTERN A and the second line of PATTERN B are outputted. It should be understood that the above example illustrates how to repeat a pattern in a lengthwise direction. As noted with respect to line 4, PATTERN B begins starting over in the lengthwise direction.

Figure 4A:
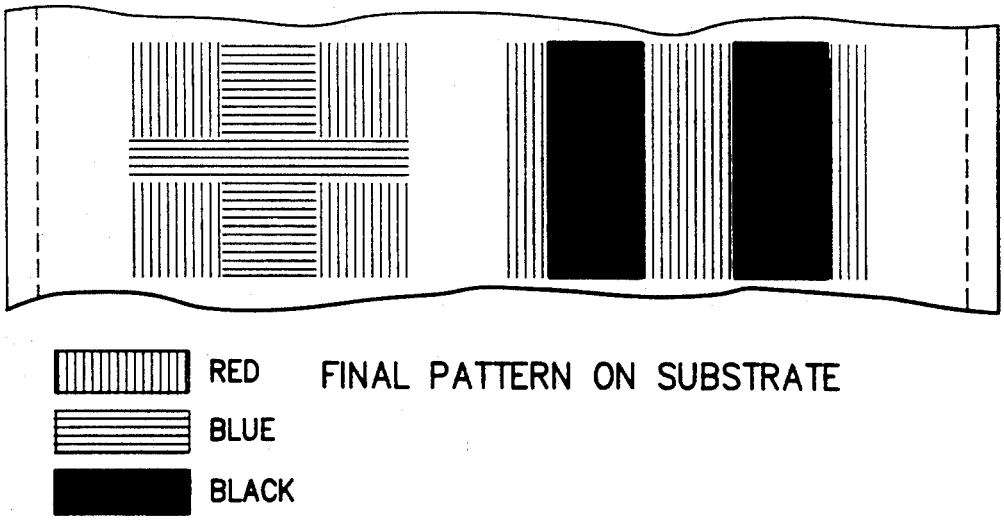

It is readily apparent from this example that a single full width pattern may be produced on the substrate or multiple independent patterns may be produced across the substrate and any pattern may be repeated across the substrate to fill the desired width for that pattern. This is shown in FIG. 4A. It is also apparent that the patterns may be shifted, expanded, or contracted depending upon how many bytes equal to 255 are outputted at the beginning and end of each line of pattern data. Note also that for proper pattern registration, repeats of the patterns may begin in the middle of a pattern, go to the end, then start at the beginning for full repeats, and then end up with a partial repeat on the other side. The programmable DMA controller board in conjunction with the use of the channel select lines makes flexible patterning possible.

Overall, the use of the programmable direct memory access controller of the present invention provides for the real-time functioning of the patterning apparatus. The DMA controller provides increased flexibility with respect to changing the pattern sequences on-line. Further, by being able to repeatedly access pattern data from memory, there is a substantial savings in memory space for the real-time processor. By this technique, far less memory is required, and the data necessary to produce a full width line of patterns can be generated much more quickly and in real-time, as opposed to off-line.

What is claimed is:

1. A textile dyeing apparatus enabling the real-time selection of destinations for pattern information, comprising:

a) a pattern control system having a plurality of destinations for receiving pattern information, said pattern control system further including means for selecting one of said destinations in response to a selectional signal;

b) a processor coupled to the pattern control system for transferring the pattern information, said processor comprising:

i) a first memory for locally storing said pattern information; and ii) a programmable direct memory access controller board, coupled to said first memory for initiating the transfer of the pattern information from the first memory in response to a transfer signal from the processor, including an output data bus, receiving the transferred pattern information, coupled in parallel with the inputs of the plurality of destinations in the pattern control system, and a selection circuit providing the selection signal in real-time to the means for selecting in response to selection information stored in the first memory.

2. A textile dyeing apparatus according to claim 1 wherein the programmable direct memory access board further comprises:

a DMA processor coupled to the first memory and the output data bus, operable in response to DMA commands stored in the first memory, to access the pattern information and selection information; and wherein said selection circuit comprises a second memory for receiving and storing the selection information from the first memory and enabling a plurality of selection lines coupled to the means for selecting.

3. A textile dyeing apparatus according to claim 2, which further comprises a third memory having an address line, data input line, data output line, read control line and write control line and is coupled to said output data bus.

4. A textile dyeing apparatus according to claim 3, which further comprises a compensating memory, coupled to said third memory, which contains compensating data and which received firing times and modifies said times in accordance with said compensating data to compensate for individual applicator characteristics.

5. A textile dyeing apparatus according to claim 4, which further comprises a fourth memory, coupled to said compensating memory, which accepts a serial stream of firing times from said compensating memory and appropriates said firing times to a plurality of individual dye jets.

6. A textile dyeing apparatus according to claim 3, wherein said second memory further comprises a First-In-First-Out-Memory.

7. A textile dyeing apparatus according to claim 3, wherein said second memory further comprises a latch means.

8. A textile dyeing apparatus according to claim 7, wherein said latch means is coupled to a means for demultiplexing data.

9. A textile dyeing apparatus according to claim 8, wherein said write control lines are coupled to a write sequencing means.

10. A textile dyeing apparatus according to claim 9, wherein said write sequencing means is connected to said means for demultiplexing data.

11. A textile dyeing apparatus according to claim 6, further comprising a data multiplexing means coupled to said First-In-First-Out-Memory and said data input line.

12. A textile dyeing apparatus according to claim 6, further comprising a selection register means coupled to said First-In-First-Out-Memory and said address line.

13. A textile dyeing apparatus according to claim 10, further comprising a multiplexing means coupled to a data multiplexing means and said means for demultiplexing data and said address line.

14. A textile dyeing apparatus according to claim 13, wherein said data multiplexing means is coupled to said First-In-First-Out-Memory and said data input line.

15. A textile dyeing apparatus according to claim 13, further comprising an auto address generating means coupled to said multiplexing means.

16. A method for enabling the real-time selection of destinations for pattern information for textile dyeing, comprising:

a. receiving pattern information from a pattern control system having a plurality of destinations;

b. selecting one of said destinations in response to a selectional signal;

c. transferring pattern information from a first memory to a programmable direct access memory controller board;

d. receiving the transferred pattern information by the inputs of said destinations; and e. repeating, in sequence, steps (a) through (d) in iterative fashion until all pattern lines have been processed.

17. The method of claim 16, which further comprises a step of accessing pattern information and selection information by use of DMA processor coupled to said first memory.

18. The method of claim 17, which further comprises a step of receiving selection information from said first memory.

19. The method of claim 18, which further comprises a step of storing selection information from said first memory into a second memory.

20. The method of claim 19, which further comprises a step of transmitting data to a third memory having an address line, data input line, data output line, read control line and write control line prior to said step of receiving the transferred pattern information by the inputs of said destinations.

21. The method of claim 20, which further comprises a step of processing data by a first data multiplexing means prior to said step of transmitting data to a third memory.

22. The method of claim 21, wherein said step of selecting one of said destinations in response to a selection signal further comprises a step of transmitting selection data from said second memory followed by a step of demultiplexing data by a demultiplexing means prior to the step of transmitting data to said third memory.

23. The method of claim 21, wherein said step of selecting one of said destinations in response to a selection signal further comprises a step of transmitting selection data from said second memory followed by a step of storing data by a selection register means prior to the step of transmitting data to said third memory.

24. The method of claim 23, which further comprises a step of transmitting data to the write control line of said third memory following the step of demultiplexing data by a demultiplexing means.

25. The method of claim 24, which further comprises a step of transmitting data to said address line of said third memory following the step of demultiplexing data by a demultiplexing means.

26. The method of claim 25, wherein said step of transmitting data to said address line of said third memory utilizes pattern information, selection information and automatically generated addresses which are then processed by a second data multiplexing means.

* * * * *